United States Patent [19]

Nakaoka et al.

[11] 4,323,403

[45] Apr. 6, 1982

[54] CONTINUOUS ANNEALING METHOD FOR COLD REDUCED STEEL STRIP

[75] Inventors: Kazuhide Nakaoka; Kenzi Araki, both of Yokohama; Kozi Iwase, Machida; Haruo Kubotera; Takao Kurihara, both of Yokohama; Nobuo Tanaka, Fukuyama, all of Japan

[73] Assignee: Nippon Kokan Kabushiki Kaisha, Tokyo, Japan

[21] Appl. No.: 60,028

[22] Filed: Jul. 23, 1979

Related U.S. Application Data

[63] Continuation of Ser. No. 926,192, Jul. 19, 1978, abandoned, which is a continuation of Ser. No. 715,863, Aug. 19, 1976, abandoned, which is a continuation-in-part of Ser. No. 558,840, Mar. 17, 1975, abandoned, which is a continuation of Ser. No. 373,744, Jun. 22, 1973, abandoned.

[30] Foreign Application Priority Data

Jun. 22, 1972 [JP] Japan ..... 47/61813

[51] Int. Cl.[3] ..... C21D 6/00; C21D 9/52

[52] U.S. Cl. ..... 148/134; 148/142

[58] Field of Search ..... 148/2, 3, 12 R, 12 C, 148/12 F, 12.3, 12.4, 142, 143, 156

[56] References Cited

U.S. PATENT DOCUMENTS

| | | | |
|---|---|---|---|
| 2,832,711 | 4/1958 | Krahe et al. | 148/143 |
| 3,099,592 | 7/1963 | Garber | 148/144 |
| 3,117,897 | 1/1964 | Williams | 148/142 |
| 3,348,981 | 10/1967 | Goda et al. | 148/143 X |
| 3,806,376 | 4/1974 | Toda et al. | 148/12 C |
| 3,839,095 | 10/1974 | Kubotera et al. | 148/12 C |
| 3,904,446 | 9/1975 | Uchida et al. | 148/12 F |
| 3,936,324 | 2/1976 | Uchida et al. | 148/12 F |

OTHER PUBLICATIONS

Garber, The Iron and Steel Institute, London, 1963, Special Report 79, "Recent Developments in Annealing", pp. 81-100.

Blickwede, "Sheet Steel-Micrometallurgy by the Millions", Transactions of the ASM, vol. 61, 1968, pp. 653-659.

*Primary Examiner*—Peter K. Skiff

*Attorney, Agent, or Firm*—Moonray Kojima

[57] ABSTRACT

In a continuous annealing process for a cold reduced steel strip substantially including a rapid cooling stage and a carbon precipitation treating stage into said process, the rapid cooling rate which is obtained by initial heating to above the recrystallization temperature and then slowly cooled for about 100 seconds to be above 200° C./sec; and the starting temperature is controlled to be between 500° C. and lower than 600° C., thereby to obtain good press-formability of the continuously annealed steel strip.

2 Claims, 2 Drawing Figures

CONTINUOUS ANNEALING METHOD FOR COLD REDUCED STEEL STRIP

This is a continuation of Ser. No. 926,192 filed 7/19/78, which is a continuation of Ser. No. 715,863 filed 8/19/76, which is a continuation-in-part of Ser. No. 558,840 filed 3/17/75, which is a continuation of Ser. No. 373,744 filed 6/22/73, all of which are abandoned.

BACKGROUND OF THE INVENTION

The present invention relates to an improvement in a continuous annealing method for obtaining cold reduced steel sheets suitable for general press forming, and more particularly, to such method using a heating cycle based on the most suitable starting temperature of rapid cooling in order to impart to the steel sheet, good press-formability, i.e. higher work hardening index and superior aging resistance.

The continuous annealing is characterized most in its extremely high productivity as compared with the so-called batch type annealing. This is due to its shorter time spent in the furnace. However, the method cannot help being defective in aging resistance and in press formability for that very reason. Thus, it was the general practice in the prior art, that this method was not employed as an annealing process for steel sheet used for drawing or press forming. However, it is true that such a continuous annealing process can embody the higher productivity and superior uniformity of the quality of steel sheet which are not obtainable through the conventional batch type annealing. Thus, if the continuous annealing process can be effectively employed to obtain steel sheets usable for drawing purposes, highly usable and unexpected commercial value can be effectively obtained.

Various proposals have heretofore been made regarding the aforementioned point. The basic and representative example is disclosed in U.S. Pat. No. 2,832,711, from which are derived many other examples and improvements. The heating cycle disclosed in U.S. Pat. No. 2,832,711 is such that the cold reduced steel strip is heated up to 1,250°-1,300° F. (677°-705° C.), rapidly cooled to below 1,000° F. (538° C.), and then maintained at 800° to 1,000° F. (427°-538° C.) for more than 30 seconds. The steel sheet thus obtained was, however, undeniably inferior to the conventional steel sheet obtained through the batch type annealing process in its press formability, particularly in work hardening index, i.e. "n" value. This was attributable to the inappropriateness of starting temperature of rapid cooling. Various improvements made on this method also presented similar defects. Thus, the practical application of the process in actual production of steel sheets has been curbed.

SUMMARY OF THE INVENTION

The present invention aims at breaking through such stagnant situation and is characterized in that the starting temperature of rapid cooling after heating and the rapid cooling rate from the heating temperature are optimumly controlled. That is to say, the cooling rate and the starting temperature should be controlled to be more than 200° C./sec. and within the range of 500° to lower than 600° C., respectively.

Thus, an object of the invention is to provide a continuous annealing method for cold reduced strip to give to said strip press formability not inferior to that produced by known batch type annealing.

Another object of the invention is to provide a continuous annealing method for cold reduced strip exhibiting uniformity of good quality covering the entire range of the steel strip, which is not obtainable using the batch type annealing process.

DETAILED DESCRIPTION OF PREFERRED EMBODIMENTS

It is well known in the art that many different mechanical properties singly or in combination, indicate the properties of cold reduced steel sheets, such as yield point, tensile strength, yield ratio, elongation, Lankford value, C.C.V. Ericksen value, hardness, grain size, etc. In the present invention, work hardening index (n value) and yield point elongation (%) in lieu of the above mentioned properties are used to indicate the properties of the present inventive steel and the comparative steel, more precisely. These properties are used because the work hardening index is an important fact to directly represent formability and at the same time the yield point elongation clearly indicates the change in the quality of the material, when it is employed by the users.

Generally, it is 2 to 3 months after manufacture that cold reduced steel sheets are actually used by the consumer. It is naturally true that the possible deterioration of the materials caused by the strain aging influences the value of the product as such. In other words, a steel sheet having excellent press formability is the steel sheet which can maintain high work hardening index (n value), low yield point (Y.P.) and small yield point elongation (Y.P.El.) up to and including the time the sheet is actually put to use.

Figure 1:
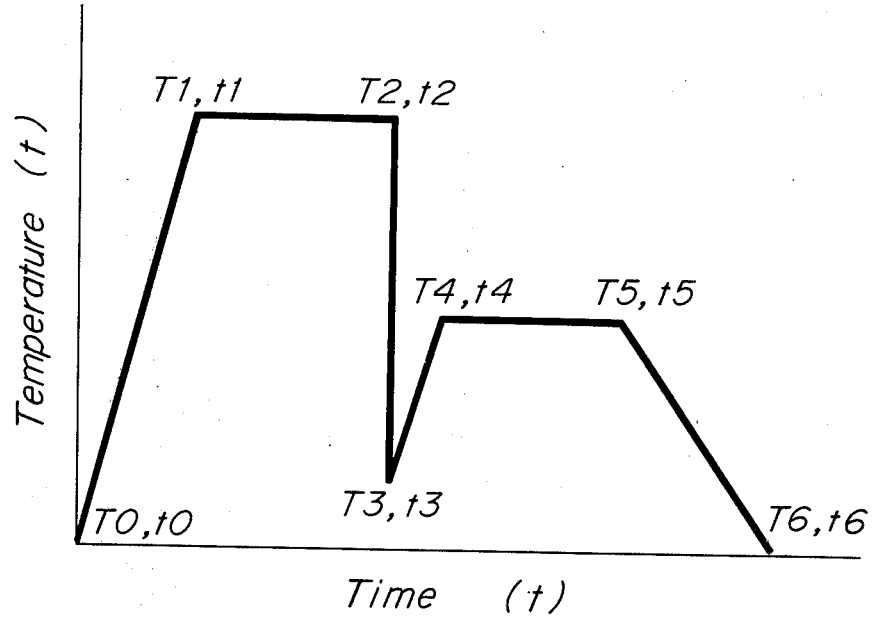
FIG. 1 depicts a typical pattern of continuous annealing cycle.

As has been explained, there have been many proposals to use continuous annealing process for steel sheets usable for press forming. FIG. 1 is a graph showing one typical pattern for heating cycle common to all of these continuous annealing processes. Such heating cycle consists of the following three steps:

1. Time lapse from the room temperature ($T_o$) to the maximum heating temperature ($T_1$) and to the temperature at which rapid cooling is started ($T_2$), i.e. ($t_o$ - $t_1$ - $t_2$). Here, the strip is heated to above the recrystallization temperature aiming at recrystallization of the cold rolled structure and at solution of carbon from carbide through slow cooling or maintaining it until said rapid cooling is started.

2. Rapid cooling from the starting temperature $T_2$ of the rapid cooling until the predetermined temperature $T_3$ during the cooling time of $t_2$-$t_3$. This process is intended to form a great number of precipitation nuclei of carbon and to cause a great amount of solute carbon in steel. This has a significant impact on the carbon precipitation treatment in the following stage.

3. Then, the strip is reheated from the temperature $T_3$ at which the cooling is stopped and reaches predetermined temperature $T_4$. During the period $t_3$ -$t_4$ - $t_5$, until temperature$T_5$, when the second rapid cooling is started, the said solute carbon is precipitated, and then finally the strip is rapidly cooled to room temperature $T_6$. Thus, the press formability not inferior to that of material obtained by the batch type annealing process, is imparted to the steel strip, when using the particular controlled temperature of starting of rapid cooling and rapid cooling rate of the instant invention.

It will be easily understood that the above-mentioned step 2 is the most crucial requirement to the quality of the strip in the heating cycle as mentioned above. The maximum effect of the above step 3 is obtained only by proper control of steps 1 and 2.Such unpracticed proposals as have been heretofore made, have failed to study the mechanism of the above mentioned step 2 in relation to steps 1 and 3 and grossly overlooked such a mechanism. If the work hardenability (n value) and aging resistance (Y.P.El.), the two values representing the properties and being contrary to each other in that the latter becomes worse as the former is improved, were to be taken into consideration, then it will become apparent that a careful consideration and determination should prevail in place of the stereotyped determination of values such as seen in the various prior art proposals.

Figure 2:
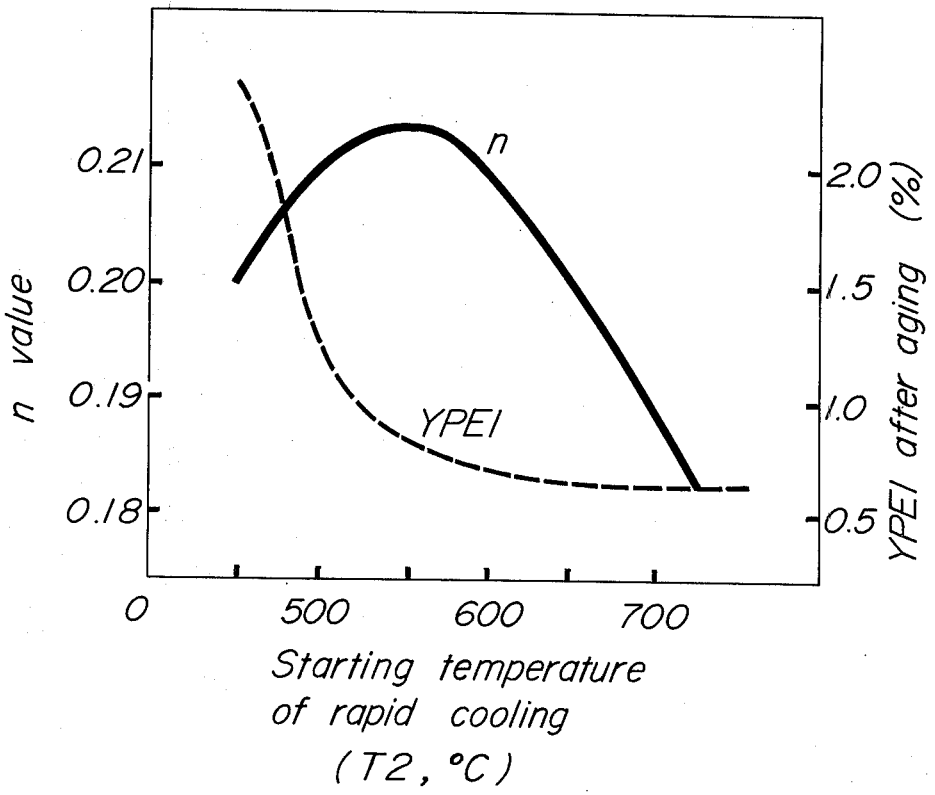
FIG. 2 depicts a graph showing "n" values and strain aging properties (Y.P.El.) of products measured against different starting temperatures of rapid cooling.

The instant inventors have performed the following and other examples to solve the aforementioned problem. In the experiment, the influence of quenching temperature on the work hardenability (n value), the yield point elongation (Y.P.El.) and hardening exponent were studied. The strip used in the experiment was an ordinary low carbon rimmed steel and the rapid cooling rate between the $T_2$ - $T_3$ was 1,000° C. constant. The result of the experiment is shown in FIG. 2. According to FIG. 2, the peak of the work hardening index (n value) is obtained at a starting temperature of between 500° C. and lower than 600° C., and the "n" value of more than 0.200 was found to be stable in this range. On the other hand, it was seen that the restoration of yield point elongation radically increased below 500° C. of the starting temperature. Thus, when such a high cooling rate as may be comparable with water quenching is used, the starting temperature of rapid cooling rate must be selected within the range of 500° to below 600° C. The accelerated aging applied in the present example was performed by giving treatment of 38° C.×8 days (equivalent to natural aging of 2 months at room temperature). Then, the rapid cooling rate was changed to 200° C./sec. (using mist spray system wherein water and gas were mixed). The result was identical to the first experiment using the rapid cooling rate of 1,000° C./sec. In summation, it was confirmed that the starting temperature of the rapid cooling should be selected within the range of 500° C. to below 600° C., in case of high cooling rate of 200° C. or above. In the above mentioned manner, it is possible to easily obtain work hardenability (n value) and aging resistance as good as those of conventional steel sheets annealed by the known batch type of annealing process.

The upper limit of $T_2$ (lower than 600° C.) was determined by taking the work hardenability (n value) into consideration. If the starting temperature of rapid cooling was to be raised higher than this, the "n" value becomes rapidly deteriorated. This is assumedly because of the introduction of numerous dislocations in the steel caused by the thermal stress based on the rapid cooling and increased fine carbides after precipitation treatment due to the increased number of carbon precipitation nuceus. The lower limit of $T_2$ (500° C.) was determined mainly in view of the aging resistance. Under the conditions of temperature below 500° C., the succeeding precipitation of carbon between $t_3$ and $t_6$ becomes difficult because of decrease of carbon precipitation nuclei and strain aging is promoted by solute carbon still remaining in steel. There is no special restriction to the upper limit of the rapid cooling rate. The highest rate possible may be applied. However, it is assumed that the maximum applicable limit is 4,000° C./sec for the steel strip of 0.8 mm thickness.

In the present inventive heat cycle, the steel strip is heated from room temperature $T_o$ to above recrystallization temperature. This is to remove the strain induced by the cold working. The recrystallization temperature for the steel strip in this instance is determined by taking various factors such as the composition of steel, reduction ratio, the heating rate, etc. But, the recrystallization temperature is assumed to be about 600° C. for ordinary low carbon steel with the reduction rate of 70 to 80% and the heating rate of continuous annealing. Thus, the lower limit of $T_1$ is set at 600° C. The upper limit for $T_1$ is set at 850° C., by taking into consideration the fact that the heating to above the temperature will make carbides coarse and cause an undesirable microsubstructure for press forming. Various heat cycles from such $T_1$ to $T_2$, the temperature at which the rapid cooling started are used including simple soaking, cooling or combination thereof.

Industrially, the water quenching is employed for rapid cooling because of the simple equipment which is used therefor. The cooling rate varies between 200° C./sec and 4000° C./sec depending on the strip thickness, water temperature and other quenching conditions. In this case, the cooling rate is the too high to control $T_3$ temperature. Therefore, $T_3$ becomes the room temperature (i.e. water temperature) inevitably.

Various patterns of the heating cycles in the precipitation treatment stage of solute carbon are conceivable. A typical pattern is such where heating up to 500° C. ($T_4$) is followed by slowly cooling down to 300° C. or about ($T_5$) and maintaining for the predetermined time of ($t_4$ - $t_5$). The present inventive process provides ($t_4$ - $t_5$) at the minimum value of 30 seconds and the suitable selection may be made depending upon the predetermined value of $T_4$. After the carbon precipitation treatment, the strip is rapidly cooled from $T_5$ to the room temperature $T_6$ by means of conventional methods (e.g. jet gas or water jacket). There is no limit for the required time $t_5$ to $t_6$.

The present inventive process may be effectively applied to such types of steel as low carbon rimmed steel, low carbon Al-killed steel and low carbon Si-killed steel. These steel types do not require any specific restrictions to their compositions. That is, there is no need to lower C, Mn, S, P, $O_2$ contents nor to specifically provide the correlation among them. There is no limit either on the manufacturing method of slabs having such ordinary range of compositions. Ordinary ingot making slabe process, continuous casting process, or other processes may be applied. The same is true of hot rolling and cold rolling conditions. However, the coiling temperature in the hot rolling stage is preferably higher than the ordinarily employed temperature, i.e. at about 680° C. to obtain softer steel sheets with higher Lankford values.

The press formability of low carbon rimmed steel for general use manufactured in ordinary batch type annealing are indicated in the following table.

| | Immediately after temper rolling | After acceleration aging of 38° C. × 8 days |
|---|---|---|
| Yield point (kg/mm$^2$) | 21.2 | 22.8 |
| Yield point elongation (%) | 0 | 1.2 |
| work hardening index (n) | 0.220 | 0.201 |

The foregoing values are compared with the present inventive steel in explaining the embodiment of the present invention.

EXAMPLE

Chemical composition of the steel strip: C=0.045%; Mn=0.36%; P=0.011%; S=0.020%. (The percents are in terms of weight).

The manufacturing conditions were as follows: The steel was manufactured in accordance with the ordinary steel making process wherein the coiling temperature in hot rolling stage is 690° C. the thickness of the sheet is 3.2 mm, and that after the cold rolling is 0.8 mm.

The continuous casting conditions were as follows: Maximum heating temperature, $T_1$=720° C. Starting temperature of rapid cooling, $T_2$=550° C. Slow cooling time between $T_1$ - $T_2$, $t_1$ - $t_2$=100 seconds. Rapid cooling method=water quenching. Terminating temperature of rapid cooling $T_3$=about 25° C. Rapid cooling rate $T_2$ - $T_3$=about 1,000° C./sec. Reheating temperature $T_4$=480° C. Starting temperature of rapid cooling $T_5$=300° C. And, slow cooling time between $T_4$ - $T_5$, $t_4$ - $t_5$=180 seconds. (The times and temperatures t and T, refer to the heat cycles in FIG. 1).

The properties of the material obtained were as follows.

| | Immediately after temper rolling. | After acceleration aging of 38° C. × 8 days. |
|---|---|---|
| Yield point (kg/mm$^2$) | 21.1 | 23.0 |
| Yield point elongation (%) | 0 | 1.0 |
| Work hardening index (n) | 0.217 | 0.201 |

As can be seen from comparison of the two tables, the inventive material is in no way inferior to the conventional materials obtained using the batch type annealing. Accordingly, use of the inventive method of continuous annealing wherein the starting temperature of rapid cooling and the cooling rate are controlled, enables production of steels having the advantageous properties of batch type annealing and the advantages produced by continuous annealing.

The foregoing description is illustrative of the principles of the invention. Numerous other variations and modifications thereof would be apparent to the worker skilled in the art. All such variations and modifications are to be considered to be within the spirit and scope of the invention.

What is claimed is:

1. In a continuous annealing process for cold reduced steel strip, of which kind of steel are low carbon rimmed, low carbon Al-killed, low carbon Si-killed steel and of which coiling temperature at hot rolling stage are above 680° C. and of which the continuous annealing process is composed of heating the strip to a temperature of more than recrystallization temperature, rapidly cooling said strip, reheating said strip to a temperature within the range of 300° C. to 500° C. for more than 10 seconds and cooling said strip to room temperature, the improvement of imparting to said steel strip immediately after the completion of said annealing process of an n-value of more than 0.21, and a yield point elongation of zero percent wherein said steel strip is slowly cooled in said heating step for a period of time of about 100 seconds to a temperature in the range of between 500° C. and lower than 600° C. and subsequently rapidly cooling from said temperature range at a rate of over 200° C./sec to below 4,000° C./sec to said room temperature, and wherein upon subjecting said steel strip to equivalent natural aging for 2 months at room temperature, said n-value decreases about 10%, and the yield point elongation is held to an increase of no more than 1.2%.

2. The process of claim 1, wherein said strip is slowly cooled to a temperature of 550° C., then rapidly cooled.

* * * * *